United States Patent [19]

Campbell et al.

[11] 4,102,550

[45] Jul. 25, 1978

[54] MINING METHOD AND APPARATUS

[75] Inventors: John A. L. Campbell, Acton; Daniel J. Moynihan, Chelmsford, both of Mass.

[73] Assignee: Peabody Coal Company, St. Louis, Mo.

[21] Appl. No.: 678,680

[22] Filed: Apr. 20, 1976

[51] Int. Cl.[2] ..... E21D 15/48

[52] U.S. Cl. ..... 299/11; 198/864; 198/865; 299/18; 299/33

[58] Field of Search ..... 299/11, 18, 33; 198/862, 864, 865; 104/124, 126

[56] References Cited

U.S. PATENT DOCUMENTS

| | | | |
|---|---|---|---|
| 304,714 | 9/1884 | Ely | 104/126 X |
| 1,432,904 | 10/1922 | Reilly | 104/126 |
| 2,880,735 | 4/1959 | Strickland | 198/862 |
| 3,731,976 | 5/1973 | Granskog | 299/18 |
| 3,856,356 | 12/1974 | Allen | 299/11 X |
| 3,920,115 | 11/1975 | Craggs | 198/262 |

FOREIGN PATENT DOCUMENTS

| | | | |
|---|---|---|---|
| 2,345,904 | 3/1975 | Fed. Rep. of Germany | 299/18 |
| 17,999 | 11/1898 | Switzerland | 104/126 |
| 3,474 | 12/1880 | United Kingdom | 104/126 |
| 1,123,934 | 8/1968 | United Kingdom | 299/33 |

*Primary Examiner*—Ernest R. Purser
*Assistant Examiner*—William F. Pate, III
*Attorney, Agent, or Firm*—Littlepage, Quaintance, Murphy, Richardson and Webner

[57] ABSTRACT

Connected support sections for a mineral face conveyor are individually supported on the forward sides of chocks which move in towards the rib of a panel behind a mining machine. Backfill is transported to the mined area behind the moved-up chocks via a conveyor supported from connected support sections on the rear sides of the chocks.

5 Claims, 5 Drawing Figures

FIG. 2
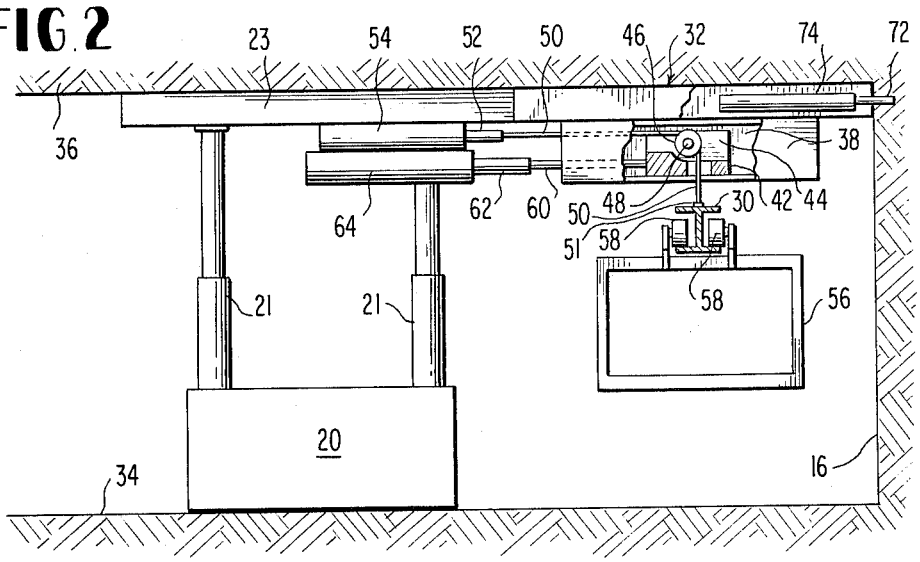
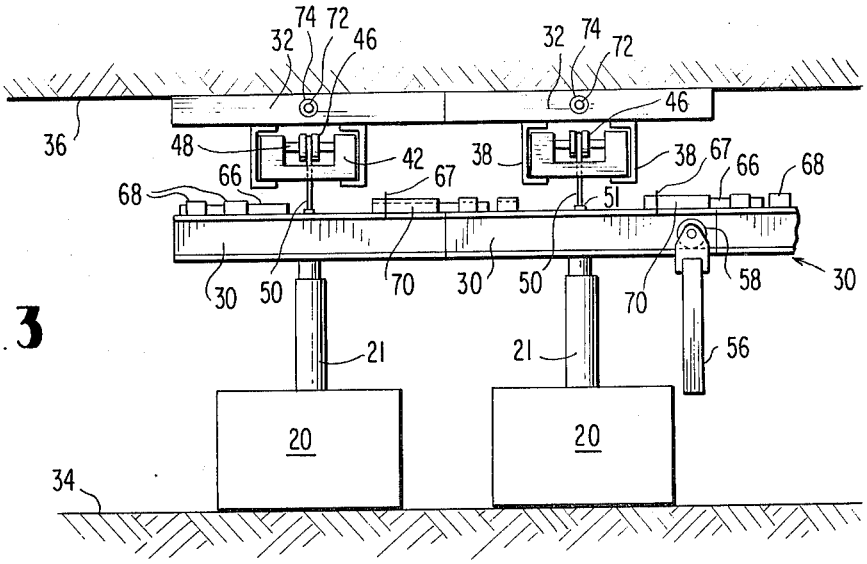
FIG. 3
FIG. 4
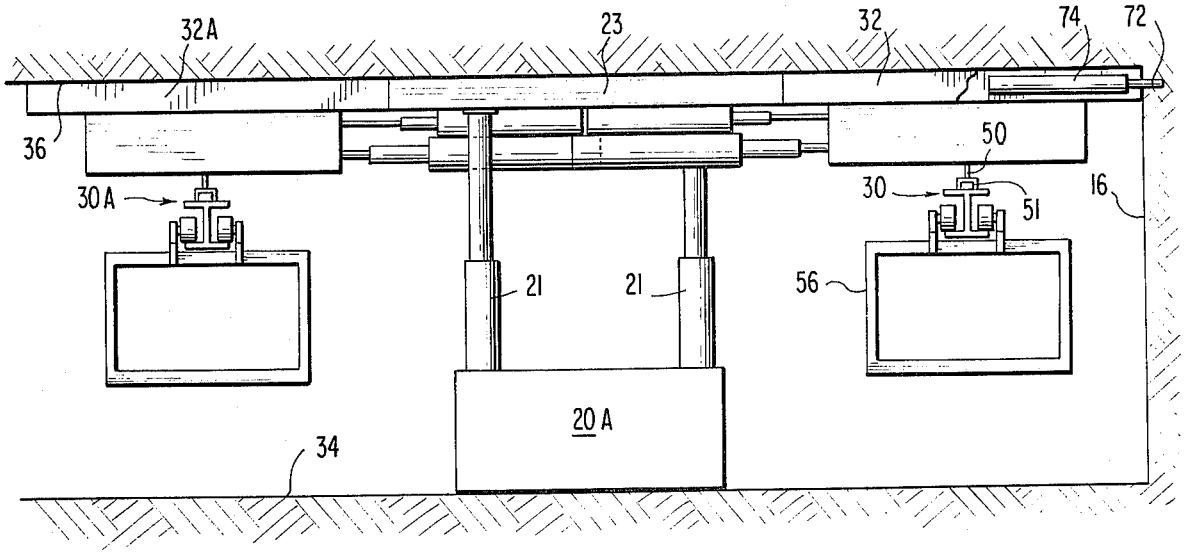

MINING METHOD AND APPARATUS

PRIOR ART

Joy Re: 23,618; Frye 2,859,022; Payne et al 3,707,218; Blumenthal et al 3,842,966; Allen et al 3,856,356; Spies 3,891,275; Craggs 3,920,115; Joy Manufacturing Company Bulletin J-321 "Continuous Pillar Mining"; Lee-Norse Company Bulletin, "Does Shortwall Pay Off?"; Long-Airdox Company Bulletin 5-973-1, "Full Dimension Continuous Haulage System".

BACKGROUND

In longwall mining systems roof supporting structures such as chocks and shields are widely used. Face haulage is accomplished with chock-positioned floor-supported conveyors. Typically, armoured drag face conveyors are positioned by frames which extend forwardly on the mine floor from the chocks. Coal dislodged from the face, by either plow or shearer, falls onto the drag conveyor and is transported to secondary mine haulage. When the coal has been removed for a certain distance down the panel the first chocks which have been passed are advanced toward the rib of the panel. At the completion of the cut all the chocks will have been moved and are normally maintained in a straight line. As the chocks advance, they also advance the conveyor which has some flexibility and is bent in a gradual curve permitting this forward movement. This system is inadequate because limited flexibility of the conveyor restricts immediate large movements of the chocks subsequent to the passage of the mining device. Furthermore, to move the conveyor to a new mining area in the mine as a result of either completing the mining in an area or due to encountered severe geological conditions, requires that the entire conveyor be disassembled, moved, and re-assembled requiring a considerable amount of time and effort.

In addition to this lack of maneuverability of the face haulage system, the longwall system is also characterized by poor respirable dust control. This is because the mining machine, plow or shearer which typically removes a 30 inch slice of coal for each pass, is operated in both directions along the face. Ventilation is unidirectional. Therefore, during the mining cycle dust is passed away from the mining machine when it is moving in one direction and over the mining machine when it returns.

Shortwall mining takes advantages of the excellent roof supporting features of the longwall system and uses the highly adaptable and flexible continuous mining machine developed for room-and-pillar mining. The continuous miner operates under the chock system which provides roof support. Because the mining cycle is unidirectional, the mining machine taking an 8–10 foot cut, the ventilation system which is also unidirectional blows all dust and methane away from the working area. Typically the face haulage system for shortwall mining utilizes shuttle cars. A car will move in under the chocks behind the continuous miner, be loaded with coal by the mining machine, back out, and transport the coal to secondary haulage. A second shuttle car then moves in under the chocks behind the continuous miner for loading. Because of the delays which result from one loaded shuttle car moving out from behind the continuous miner and the empty shuttle car moving into position, the length of the wall had to be shortened. Thus, the so-called shortwall system.

A comparable chock system is disclosed in Allen et al (supra). This system has advantages in that the roof support, mining and trnsportation are coordinated so that productivity is increased and safety enhanced. However, it has certain disadvantages in that the conveyor's supports must be withdrawn and re-installed behind the continuous miner each time a new cut through the panel is made.

Recently, Joy Manufacturing Company has disclosed a chock system which is used in conjunction with a continuous miner and which partakes of characteristics of both long and shortwall mining. After entries have been developed in a room-and-pillar manner so as to leave a panel there between, and roof bolts have been implaced, chocks are installed in the entry adjacent to the mining panel. Then the mining machine starts a cut through the panel and, as the machine advances along the cut, the roof support chocks move in, one by one, along the row behind it, a ground supported flexible conveyor train advances along behind the continuous miner beneath the chock arms. This system is not useful because of problems of maneuvering, belt carryover, and materials for construction particularly associated with the belt flexibility.

The Lee-Norse Company and the Long-Airdox Company have also attempted to overcome the face haulage dilemma for shortwall mining through the use of their respective extensible belt systems. However, problems resulting from the inability to adequately maneuver around corners also makes these systems unsatisfactory.

The objective now is to provide a new system wherein developed and commercially available face haulage equipment can be used with the advantageous features of both the longwall and shortwall systems and provide features which are not available in any system. That is, the roof support and long operating face features of the longwall system, and the highly mobile and flexible mining machine, the continuous miner, and the unidirectional ventilation scheme from the shortwall system, will be utilized by providing an articulated support system which is attached to the chocks of the roof support system. The articulated support system allows ancillary systems to be moved in a continuous manner into and out of the working face.

The primary objective of the invention is to provide an ancillary support system which is articulated in such a manner that as the individual roof support members, chocks, are advanced behind a mining machine, each one carries forward a segment of the ancillary support system which, when linked together, form the whole ancillary support system. As used hereinafter and in the appended claims, the term chock or chocks shall mean chocks, shields, or other related mechanical devices for roof support. The term mining machine shall refer to continuous miner, header, borer, auger, cutter, shearer, plow or other related commercial mechanical devices used to obtain minerals from the earth's crust. It is further noted that for the purpose of this specification and the appended claims that the term conveyor systems is not limited to the preferred embodiment, the flexible frame endless conveyor. It will be apparent to those skilled in the art that the ancillary support system is readily adaptable to support other conveyance systems such as multiple-unit cascading trains, flexible conveyor trains, hydraulic tube transport, pneumatic tube transport, etc.

The ancillary support system of the subject invention provides a mechanism wherein individual monorail sections are used to form a continuous overhead monorail that is used to support a flexible frame endless conveyor that therein provides continuous face haulage for the mining system. To support the flexible frame endless conveyor, individual monorail sections are suspended from the roof beams on the forward side of the chocks. As the chocks are moved in behind the continuous miner, each of the monorail sections is moved into place and connected onto the last previously moved-in one so as to extend the monorail terminus forwardly as the continuous miner advances. According to one embodiment of the invention, the monorail ancillary support system sections are mounted only on forward sides of the chocks. According to another embodiment, similar monorail ancillary support system sections on the rear side of the chocks are used for supporting a second flexible frame conveyor. The first conveyor running along the forward side of the chocks conveying the mineral away from the mining machine. The second conveyor on a retreating trackway on the rear side of the chocks conveying backfill material into the subsidence area of the mine.

These and other objectives will be apparent from the following specification and drawings in which:

FIG. 2 is a side elevation of a chock-supported monorail section;

FIG. 3 is a front view of two chock-supported monorail sections connected end-to-end;

FIG. 4 is a view similar to FIG. 2, but showing a modified form wherein monorail sections are supported on both rearwardly and forwardly extending chock arms; and, FIG. 5 is a diagrammatic plan view of a system utilizing the two chock supported monorails of FIG. 4.

Figure 1:
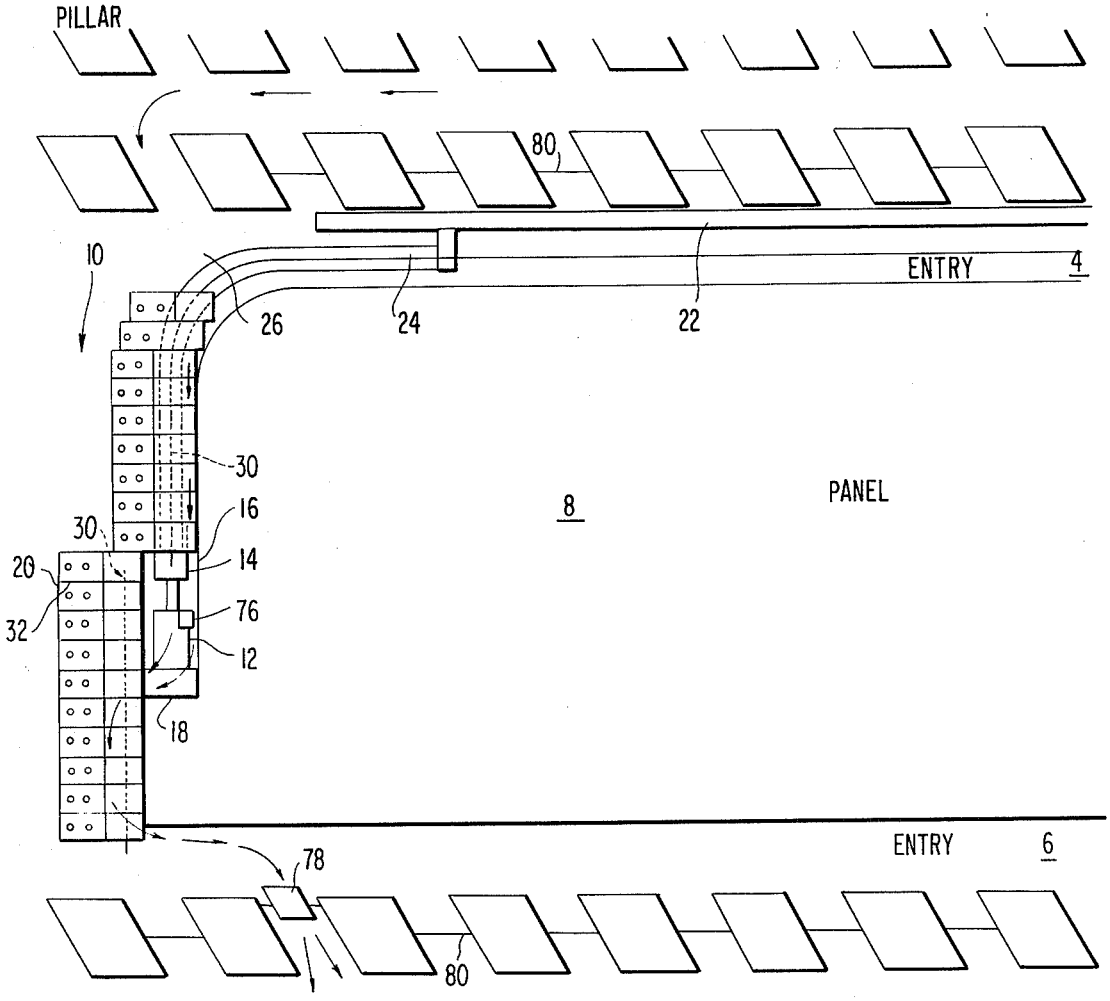
FIG. 1 is a diagrammatic plan view of the new system in operation.

Referring now to the specification and drawings in which like reference numerals denote similar elements, FIG. 1 diagrammatically illustrates the procedure of operation where spaced entries 4 and 6 have been cut so as to leave a panel 8 therebetween and a cross cut 10 has been made between entries 4 and 6, the mine roof over these cuts thus far have been protected with the usual roof bolting procedure. In FIG. 1, it may be seen that a continuous miner 12, with its surge car 14 behind it, has turned from entry 4 and is proceeding along rib 16 to cut away the coal from face 18. As it so proceeds, chocks 20 are moved in behind to support the mine roof over the continuous miner and its surge car.

Coal is transported to the surface by a secondary and main conveyor system 22 which, during the advance phase of the operation, can be supplied with coal by a system such as a flexible frame conveyor supported by a monorail mounted on the mine roof, per the Craggs patent (supra). The roof-supported monorail system, from a transition point indicated generally at the line 26, merges into the system with which the present invention is concerned, wherein the flexible frame of the endless conveyor 24 is supported not by a monorail anchored to the roof, but, rather, by a monorail made up of connected end-to-end monorail sections 30 suspended from the forwardly extending chock arms 32. As will be apparent hereinafter, as each chock 20 moves in behind the continuous miner, the rear end of a monorail section 30 is joined to the forward end of that section of the monorail which has previously moved into the course behind the continuous miner.

Referring now to FIGS. 2 and 3 of the drawings, there are illustrated chocks 20 engaged between the floor 34 and the roof 36 of the mine. The details of the chocks are not illustrated, these being of conventional form, with jacks 21 which raise the roof beam 23 against the mine roof, and they may be of the self-advancing type, and they may also have outwardly or forwardly extensible arms 32. Running lengthwise of the chock arms 32 are a spaced pair of channels 38 whose concave sides face one another. Sliding in the channels 38 is a U-shaped slide or roller assembly 42 whose arms 44 extend towards the chock, and a sheave 46 is rotatably supported by a cross shaft 48 between the slide arms 44. Each individual monorail section 30 is supported by a cable or chain 50 which runs over sheave 46 and is connected to the ram 52 of a hydraulic jack 54 so that as the jack ram moves forwardly or rearwardly the monorail section is raised and lowered. The frames 56 which support the flexible frame endless conveyor (See Craggs, supra) are supported by trolley wheels 58 which run along the flanges of the monorail sections 30, which are, essentially, H-beams. The free ends of the U-shape slide or roller assembly 42 are connected by a yoke 60 to the ram 62 of a hydraulic jack 64 so that the monorail sections can be adjusted laterally as well as vertically. A ball and socket 51 is used to attach the monorail section 30. The ball and socket 51 allows the third axis of movement in addition to angular adjustment.

Various means may be employed for connecting the monorail sections end to end, for example, in FIG. 3 the slides 66 which are slidably supported beneath straps 68 on one end of a monorail section 30, and which engage beneath elongate inverted channels 70 on the other end of the monorail section. To maintain stability slide 66 is secured with a pin 67 into the inverted channels 70.

Means can be provided for supporting the free end of the chock arms 32. For example, a spike 72 is driven into the rib 16 by a hydraulic jack 74, or a leg (not shown) can be dropped from the free end of the chock arm 32 to the floor for support.

Figure 5:
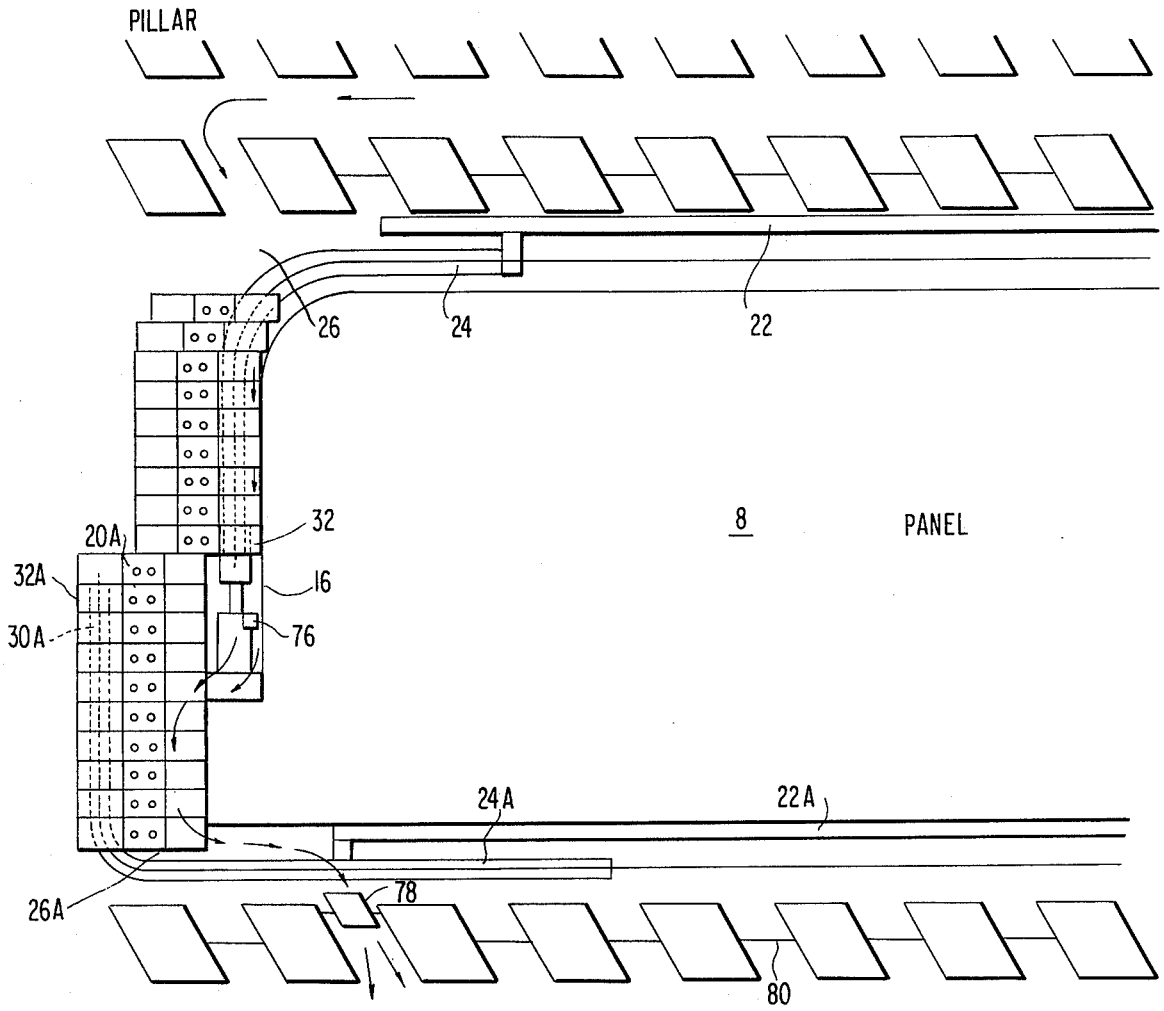

The chock and monorail support shown in FIGS. 4 and 5 is essentially like that shown in FIGS. 2 and 3, except in that the chock 20A is provided with a rearwardly extending arm 32A as well as a forwardly extending arm 32. The monorail 30A whose sections are supported on the rearwardly extending chock arms 32A connected to a roof-supported monorail system at 26A. The conveyor 24A which is supported on the monorail 30A is supplied by a conveyor 22A with gob or other material for back filling the area behind the moved-up chocks 20A. A retreating trackway for backfill material is created by disconnecting adjacent ends of previously connected individual track sections supported on rear sides of chocks as mining machine is advanced along a cut.

In order to stow the gob material, it may be necessary to implement a device at the end of the cited conveyor 24A, such as a section of high speed conveyor, which imparts a high kinetic energy to the gob material. This would allow the gobbed material to be thrown into the place vacated by the preceding advanced chock. In addition, it would be desirous to construct the end of the conveyor 24A in such a manner that the conveyor is given directional control. That is, the stream of gob from the conveyor can be directed to backfill a given spot.

In both embodiments, the mine ventilation air can be assisted by air impelled by a fan 76 on the continuous miner which sweeps rib 16 and face 18 clear of dust and methane. The air stream thence may flow through a scrubber 778 to an entry. Curtains 80 are set up between the pillars to provide suitable air flow systems.

When the continuous miner completes its cross cut, it backs out to the entry from whence it started and commences a new cut. As each chock is readied to move in behind it, the monorail section carried by it is disconnected from the previous row and re-connected into the newly forming row. Conventional means, not detailed, are used for connecting each new chock-supported monorail system to the roof-supported monorail system running to the secondary conveyor and thence to the main conveyor and ground level.

I claim:

1. An apparatus for an ancillary support system, in combination, a mine roof chock a flexible frame conveyor including means for suspending the frame thereof for movement along an overhead trackway, means for supporting an elongate overhead track member on said chock, and means for releasably joining the ends of said overhead track member to ends of like members which, joined end-to-end, constitute serial parts of said overhead trackway, said chock includng a roof beam having a first portion thereof overlying vertically adjustable jack means and a second portion constituting an arm having a free end extending laterally outward in one direction from the first portion, the means for supporting said overhead track member being mounted on said second portion, the means for supporting an overhead track member on said chock providing freedom of directional movement of said track member relative to said chock in vertical and horizontal planes.

2. An apparatus for an ancillary support system, in combination, a mine roof chock, a flexible frame conveyor including means for suspending the frame thereof for movement along an overhead trackway, means for supporting an elongate overhead track member on said chock, and means for releasably joining the ends of said overhead track member to ends of like members which, joined end-to-end, constitute serial parts of said overhead trackway, said chock including a roof beam having a first portion thereof overlying vertically adjustable jack means and a second portion constituting an arm having a free end extending laterally outward in one direction from the first portion, the means for supporting said overhead track member being mounted on said second portion, and means on the free end of said arm for supporting the same from the ground.

3. A method for mining material with continuous haulage of said material, comprising advancing a continuous mining machine along a cut line through a paint in short wall mode, successively moving up individual chock units with freedom of constraint by other chock units to form an advancing row of roof support behind the advancing mining machine, forming an advancing trackway behind the advancing mining machine by joining adjacent ends of individual track sections supported for substantial freedom of movement relative to the chock units on forward sides of the individual chock units as said chock units are moved individually, and continuously hauling mined material away from the mining machine on a conveyor supported on said trackway.

4. A method for mining material with continuous haulage of said material, comprising advancing a continuous mining machine along a cut through a panel in short wall mode, successively moving up individual chock units along the cut line to form and advancing row of roof support behind the mining machine while correspondingly the same chock units represent a retreating row of roof support which terminates in a subsidence area, forming an advancing trackway behind the advancing mining machine by connecting adjacent ends of individual track sections respectively supported for substantial freedom of movement on forward sides of the individual chock units as said chock units are moved up individually while creating a retreating trackway by disconnecting adjacent ends of previously connected individual track sections respectively supported for substantial freedom of movement on rear sides of said chock units, continuously, transporting mined material away from the mining machine on a conveyor supported on the advancing trackway, and continuously transporting backfill material to the subsidence area on a conveyor supported on the retreating trackway.

5. In an apparatus for an ancillary support system, a mine roof chock having opposite sides and ends and an arm extending laterally outward from one end thereof, an elongated overhead trackway member for a conveyor supported on said arms, said trackway member including means on opposite ends thereof for connecting and disconnecting the same to ends of like members, whereby said trackway members may be connected to form an elongate overhead trackway along one side of a row of chocks, the length of said trackway member being substantially equal to the width of said chock as measured between the opposite sides thereof, and means for suspending said overhead trackway member from said arm, the means for suspending the trackway member from said arm providing freedom of movement of said member in horizontal and vertical planes.

* * * * *